US008876677B2

(12) United States Patent
Meininger et al.

(10) Patent No.: US 8,876,677 B2
(45) Date of Patent: Nov. 4, 2014

(54) UPPER BODY EXERCISE APPARATUS, METHOD AND SYSTEM

(75) Inventors: Justin B. Meininger, Miami Beach, FL (US); Steven J. Miller, Tamarac, FL (US)

(73) Assignee: Meant-2-Move LLC, Coral Gables, FL (US)

( * ) Notice: Subject to any disclaimer, the term of this patent is extended or adjusted under 35 U.S.C. 154(b) by 351 days.

(21) Appl. No.: 13/248,018

(22) Filed: Sep. 28, 2011

(65) Prior Publication Data

US 2012/0238420 A1 Sep. 20, 2012

Related U.S. Application Data

(63) Continuation-in-part of application No. 13/050,927, filed on Mar. 17, 2011.

(51) Int. Cl.

| | |
|---|---|
| ***A63B 21/00*** | (2006.01) |
| ***A63B 71/00*** | (2006.01) |
| ***A63B 21/015*** | (2006.01) |
| ***A63B 22/20*** | (2006.01) |
| ***A63B 23/035*** | (2006.01) |
| ***A63B 23/12*** | (2006.01) |

(52) U.S. Cl.

CPC ..... *A63B 21/00076* (2013.01); *A63B 21/1469* (2013.01); *A63B 21/1496* (2013.01); *A63B 21/015* (2013.01); *A63B 21/1484* (2013.01); *A63B 22/203* (2013.01); *A63B 23/03541* (2013.01); *A63B 23/1236* (2013.01); *A63B 2208/0257* (2013.01)

USPC ..... 482/132; 482/131; 482/141

(58) Field of Classification Search

CPC .... A63B 21/072; A63B 22/20; A63B 21/068; A63B 23/0205; A63B 23/0211; A63B 23/0277

USPC ..... 482/44, 45, 46, 131, 132, 140, 141

See application file for complete search history.

(56) References Cited

U.S. PATENT DOCUMENTS

| | | | | | |
|---|---|---|---|---|---|
| 3,796,431 | A * | 3/1974 | Sinyard | 482/132 |
| 3,809,393 | A * | 5/1974 | Jones | 482/132 |
| 4,501,434 | A * | 2/1985 | Dupuis | 280/206 |
| 4,768,778 | A * | 9/1988 | Thomas, Jr. | 482/141 |
| 5,632,707 | A * | 5/1997 | Daniel et al. | 482/8 |
| 6,942,605 | B1 * | 9/2005 | Sukhovitsky | 482/132 |
| 7,238,147 | B2 * | 7/2007 | Mills et al. | 482/106 |
| D579,503 | S * | 10/2008 | Hauser et al. | D21/662 |
| 7,468,025 | B2 * | 12/2008 | Hauser et al. | 482/141 |
| D585,947 | S * | 2/2009 | Royster | D21/662 |
| 7,553,267 | B1 * | 6/2009 | Hauser et al. | 482/141 |
| D597,153 | S * | 7/2009 | Friedman et al. | D21/662 |
| D599,417 | S * | 9/2009 | Friedman et al. | D21/662 |
| 7,621,858 | B2 * | 11/2009 | Sheron | 482/132 |
| 7,935,039 | B2 * | 5/2011 | Dannenberg | 482/141 |

(Continued)

*Primary Examiner* — Loan H Thanh

*Assistant Examiner* — Sundhara Ganesan

(74) *Attorney, Agent, or Firm* — The Miller Law Offices, PLC; Steven J. Miller, Esq.

(57) ABSTRACT

The present invention relates to an apparatus, method and system for a human individual to exercise his body in a novel manner wherein the user, when he is in the prone position, is able to move his arms, while holding the instant apparatus placed on a relatively flat surface, in all three planes of human motion simultaneously; i.e. saggital, frontal and transverse planes.

4 Claims, 3 Drawing Sheets

(56) References Cited

U.S. PATENT DOCUMENTS

| | | | | |
|---|---|---|---|---|
| D653,714 | S * | 2/2012 | Meininger et al. | D21/662 |
| D654,544 | S * | 2/2012 | Sliemers | D21/662 |
| 8,444,532 | B1 * | 5/2013 | Barcena | 482/51 |
| 2007/0238587 | A1 * | 10/2007 | Darben | 482/68 |
| 2007/0298947 | A1 * | 12/2007 | Eksteen | 482/141 |
| 2009/0305853 | A1 * | 12/2009 | Jordan | 482/132 |
| 2010/0004105 | A1 * | 1/2010 | Peddar | 482/132 |
| 2010/0130337 | A1 * | 5/2010 | Stewart | 482/121 |

* cited by examiner

UPPER BODY EXERCISE APPARATUS, METHOD AND SYSTEM

CROSS REFERENCE TO RELATED APPLICATIONS

This Continuation-In-Part application claims priority from applicants' Non-Provisional application Ser. No. 13/050,927, filed on Mar. 17, 2011, which claimed priority from applicants' Provisional Patent Application No. 61/390,140 filed on Oct. 5, 2010.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

The present invention relates to an apparatus, method and system for a human individual to exercise his body in a novel manner wherein the user, when he is in the prone position, is able to move one or both of his arms, while holding the instant apparatus placed on a relatively flat surface, in all three planes of human motion simultaneously; i.e. saggital, frontal and transverse planes.

In the prior art, a plethora of devices have focused on prone position exercise devices; i.e. push-up assist devices that allowed users a greater range of vertical motion by lifting the users hands some distance off of the ground on a stable surface, while other devices made some further improvements by further allowing only arm rotation or twisting, while the user was doing a push up with the aforesaid devices, said improved device being limited by being stationary or immobile on a flat surface, and only permitting the user to twist said user's arm's while doing a push-up, positioning as disclosed in Hauser, Friedman, Mills series of patents, U.S. Pat. No. 7,238,147, U.S. Pat. No. 7,468,025, U.S. Pat. No. 7,553,267, D579503, D597153, D599417; i.e. the device itself was fixed to the floor or flat surface by the weight of the user and friction, unable to slide across the flat surface in any direction, simultaneously while the user was holding the device in his hands.

While these devices fulfill their respective, particular objective and requirements, the aforementioned patents did not describe an upper body exercise and physical conditioning device that is described herein by the instant application. This instant invention allows a user to move his arms in a novel manner, i.e. the user can position his hands on the device (in any manner) and then move his arms in all three planes of human motion (saggital, frontal and transverse planes), whether in one plane, or more than one plane at the same time, while the device is free to slide in an infinite number of directions while placed on the floor, and while the user is bodily in the prone position. This permits the exercise of numerous additional groups of muscle groups compared to that of the prior art. The instant invention also the exercise of, and the resultant improvement in, a user's upper body's joints ranges of motion, thereby improving the user's joint flexibility. In addition, the invention's structural geometric arrangement allows for rigid, secure and yet a simple and lightweight design. The instant application improves upon the prior art, with an apparatus, method and system that allows for user's arms to move in the saggital, frontal and transverse planes of human motion simultaneously. None of the prior art has allowed for this broad range of exercise versatility in a single device. Some of the muscle groups that may be exercised by this novel device include, but are not limited to, pectoral major, pectoral minor, abdominals, triceps, and deltoids. The instant invention further allows for arm flexion, extension, internal and external rotation, adduction and abduction. The prior art was not capable of exercising as many muscles, joints and ranges of human motion, at one time, with a single system.

Further, the devices in the prior art generally had more moving parts than the instant invention, which made them more difficult and expensive to manufacture and would increase their chances for failure. The applicant's instant invention solves all of these aforesaid problems and limitations in the prior art by fabricating the device with strong, resilient and flexible materials, including, but not limited to injection molded plastics, and using high hertz contact strength bearing configurations at the interface of stationary (base) and moving parts (spherical rolling balls one in each recess in said non-rolling base), said bearings being either friction bearings wherein the stationary base surface and/or the rolling spherical balls which move relative to one another comprise self-lubricating composite materials, or said bearings being configured as an anti-friction type wherein the sliding friction between the stationary base and the rotating ball surfaces is replaced with primarily rolling friction (although some sliding friction may exist) by placing a plurality of cylindrical or spherical rollers with axles mounted in cradles in the recesses in the stationary base and said rollers contacting with point or line contact, and rolling with spherical ball in each recess in the base. One of said solid bearing materials being fabricated of halogen-hydrocarbon-polymers. This new design is structurally simpler than the prior art, thereby making it easier to use, and substantially more simple and less costly to manufacture and maintain. Therefore, the applicant's instant invention solves these aforesaid problems and limitations. It can be appreciated that there exists a continuing need for a upper body exercise apparatus, method and system, which serves to exercise the largest grouping of human body muscle groups, than any other apparatus, method or system disclosed in the prior art. In this regard, the present invention substantially fulfills this need.

SUMMARY OF THE INVENTION

In the view of the above stated disadvantages inherent in the known types of devices now present in the prior art, the present invention provides an improved upper body exercise device. As such, the general purpose of the present invention, which will be described subsequently in greater detail, is to provide a new unique upper body exercise device which has all the advantages of the prior art and none of the disadvantages.

To attain this, the present invention comprises an apparatus, method and system that has a means for a user to grasp said apparatus with his hands (one identical device in each of user's hands, or in the alternate the user may choose to grasp only one device with one or both of his hands), then since the apparatus has a means for sliding across the flat surface it is resting on (said means comprising a plurality of spherically shaped balls suitably retained within the base of said apparatus), in any direction simultaneously, with little or no friction, the user then has the option to move his arms together or alternately forward and back in the human saggital plane, and/or laterally in the human frontal plane, and/or through arm sweep rotation motions about a user's shoulders in the human transverse plane, or in any possible combination of these aforesaid human motions; thereby rendering the user able to exercise his muscles and joints in an infinite number of directions, to exercise several muscle groups and joints simultaneously. This improves the user's strength and joint range of motion.

There has thus been outlined, rather broadly, the more important features of this invention in order that the detailed description thereof that follows may be better understood, and in order that the present contribution to the art may be better appreciated. There are, of course, additional features of the invention that will be described hereinafter.

In this respect, before explaining the disclosed embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the limited claims herein be regarded as including such equivalent constructions insofar as they do not depart from the spirit and scope of the present invention.

It is therefore an object of the present invention to provide a novel unique upper body exercise apparatus, method and system which has all the advantages of the prior art upper body exercise devices and none of the disadvantages.

It is another object of the present invention to provide a novel unique upper body exercise device which may be more easily and more efficiently manufactured and marketed than the prior art.

It is a further object of the present invention to provide a novel unique upper body exercise device which is fabricated of durable and reliable materials, simpler design and less costly to manufacture and maintain.

An even further object of the present invention is to provide a novel unique upper body exercise device which is susceptible of an even lower cost of manufacture with regard to both materials and labor, and which accordingly is then susceptible of low prices of sale to the consuming public, thereby making such a device even more economically available to the buying public, yet with greater capabilities than that disclosed in the prior art.

Even still another object of the present invention is to provide a novel unique upper body exercise device for allowing a person to move their arms while grasping the apparatus, in all three planes of human motion (saggital, frontal and transverse) simultaneously, and in any degree of each of these three planes, that the user so desires, to achieve the specific results that a particular user wants and needs.

For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

In the drawings.

DESCRIPTION OF THE PREFERRED EMBODIMENT

Figure 1:
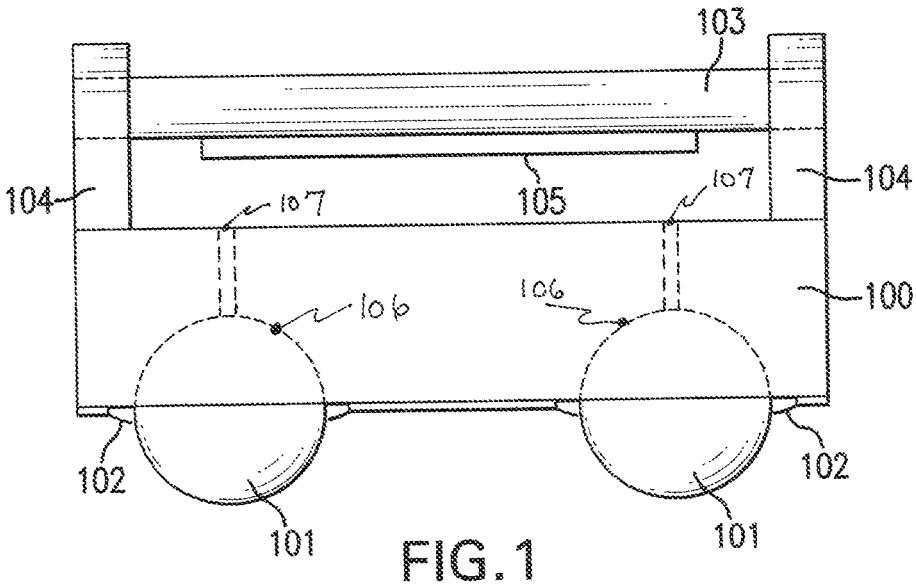
FIG. 1 is an elevation view of the preferred embodiment of the upper body exercise device constructed in accordance with the principles of the present invention.
Figure 2:
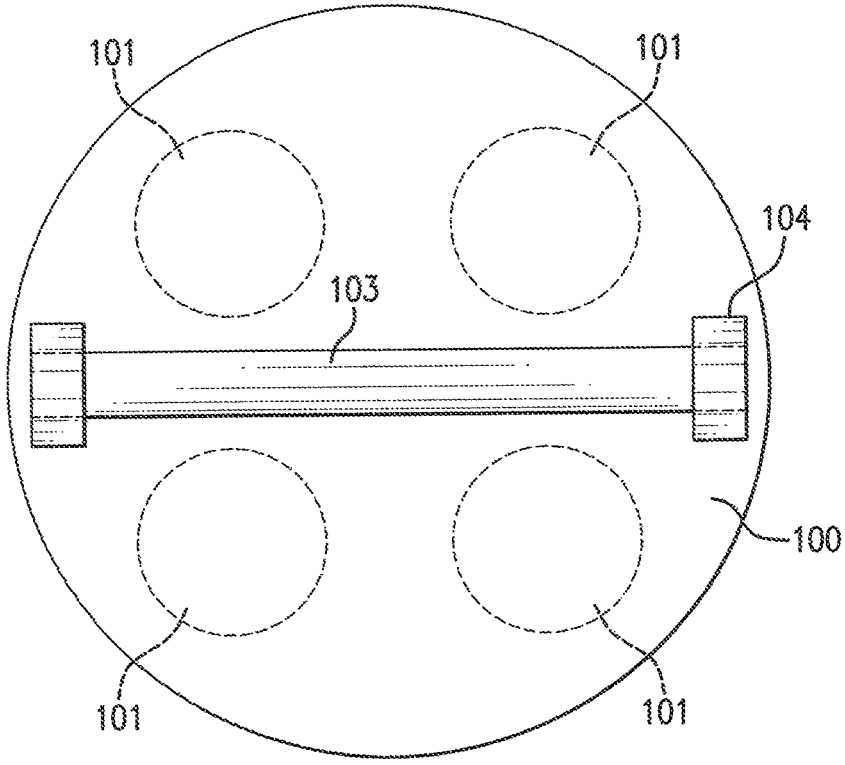
FIG. 2 is a plan view of one preferred embodiment of the upper body exercise device constructed in accordance with the principles of the present invention.
Figure 3:
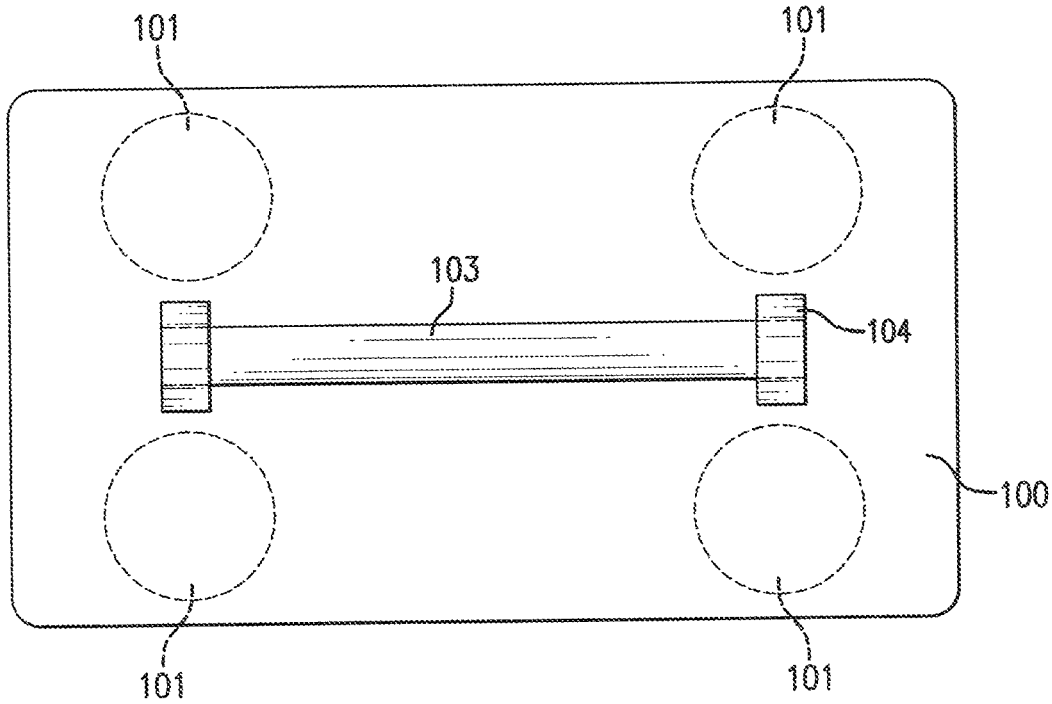
FIG. 3 is a plan view of another preferred embodiment of the upper body exercise device constructed in accordance with the principles of the present invention.

With reference now to FIG. 1, FIG. 2 and FIG. 3, are the preferred embodiments of the upper body exercise device embodying the principles and concepts of the present invention.

In the preferred embodiment of FIG. 1 and FIG. 2, the device has a generally circular configuration base (100), in which there is a minimum of three, but in this case four spherically shaped balls (101) placed in half spherically or cylindrically shaped recesses (one recess for each rolling ball) within the base (100), the balls (101) being held within the base (100) by suitable means [said means comprising circular shaped retaining clips, a cover plate over the entire bottom of the base with holes cut for the rolling balls, or the recess having a reduced diameter interference fit at the very bottom of the base (102)]. In the preferred embodiment of FIG. 1 and FIG. 3, the device has a generally rectangular configuration non-rolling base (100), in which there is a minimum of three, but in this case four spherically shaped rollers (101) placed in half spherically or cylindrically shaped recesses within the base (100), the spherically shaped balls (101) being held within the base (100) by suitable means [said means comprising circular shaped retaining clips, a cover plate over the entire bottom of the base with holes cut for the rolling balls, or the recess having a reduced diameter interference fit at the very bottom of the base (102)]. The aforesaid rolling ball retention means prevent the spherically shaped balls from dropping out of the device's base if the device is lifted off of the floor by the user. In the preferred embodiments the user grabs the two identical devices, one in each of his two hands using a grab bar (103), said grab bar being mounted in, and supported by the two side support side plates (104). Optionally, there may be a user brake bar (105) mounted on the grab bar (103), wherein the user may optionally grab and then squeeze the brake bar to increase the resistance for the aforesaid spherical balls from freely rolling, thereby giving the user greater control of his own exercise mobility and resistance training. At the interface of the spherical balls (101) and the spherical or cylindrical recesses placed in the base (100) for said balls (101), is a high hertz contact stress capable friction or anti-friction type bearing surfaces (106), said bearings being either friction bearings wherein the stationary base surface and/or the rolling spherical balls which move relative to one another comprise self-lubricating composite materials, or said bearings being configured as an anti-friction type wherein the sliding friction between the stationary base and the rotating ball surfaces is replaced with primarily rolling friction (although some sliding friction may exist) by placing a plurality of cylindrical or spherical bearing rollers being mounted in cradles in the recesses in the stationary base and said rollers contacting with point or line contact, and rolling with spherical ball in each recess in the base (106). Optionally, said apparatus has access holes (107) at the bottom of the recesses traversing through the base to facilitate removal of the spherical balls and to facilitate cleaning and maintenance of the apparatus.

Not illustrated in the drawing, is a brake pad type mechanism suitably linked to the brake bar (105), which applies adjustable braking load, as applied by the user squeezing the brake bar (105). Said brake bar components being configured to allow the user to personally adjust the rate at which the spherical balls may roll in any or all of the three directions of human motion; i.e. saggital, frontal and/or transverse.

While the present invention has been particularly described, in conjunction with preferred embodiments, it is evident that many alternatives, modifications and variations will be apparent to those skilled in the art in light of the foregoing description. For one example, the spherical rollers may be replaced by a combination system that provides for the same freedom of three dimensional motions that the spherical rollers provide; i.e. cylindrical rollers not mounted directly on base plate (100), but rather said four rollers each being mounted on a four fully rotational discs, with said discs then being mounted on the bottom of the base plate (100). It is therefore contemplated that the instant disclosure will embrace any such alternatives, modifications and variations as falling within the true scope and spirit of the present invention.

In so far as the description above and the accompanying drawing disclose any additional subject matter that is not within the scope of the limited claims below, the inventions are not dedicated to the public and the right to file one or more applications to claim such additional inventions is reserved.

While the invention has been described in connection with a preferred embodiments, it is not intended to limit the scope of the invention to the particular form set forth, but on the contrary, it is intended to cover such alternatives, modifications, and equivalents as may be included within the spirit and scope of the invention.

What is claimed is:

1. An upper body exercise apparatus, comprising:

two identical devices wherein a user grasps a cylindrically shaped handle generally oriented parallel to a supporting surface, on each device with each of his hands, being mounted in, and supported by a structure that is generally oriented perpendicular to said supporting surface, said structure being connected to and supported by a solid base, the base and handle support structure are fabricated as one molded piece, in said one molded piece solid base there are three or more spherically shaped balls placed in recesses within said base, in said same one molded piece a reduced diameter interference fit to retain said spherical balls within their respective recesses in said base being provided, high hertz contact strength bearing surfaces being integral in said recesses located within said single molded piece base thereby providing a low friction interface of the moving spherically shaped balls and the stationary recesses in said base, and said recesses capturing the upper half of said balls, said spherically shaped balls then permitting a user positioned in the prone position, to slide each of the two identical devices simultaneously while said user is grasping the handles of each devices in each of his hands, across a relatively flat surface, and in any direction simultaneously and independently, thereby allowing said user the capability of exercising said user's muscles and joints in said user's sagittal plane, and laterally in said user's frontal plane, and through said user's arm sweep rotation motions about a user's shoulders in the transverse plane, or in any possible combination of these aforesaid motions.

2. The apparatus of claim 1, wherein the high hertz contact strength bearing surfaces are part of the single molded base piece are of the friction type having two self-lubricated solid surfaces sliding relative to one another.

3. The apparatus of claim 1, wherein the high hertz contact strength bearing surfaces are of the anti-friction type wherein the sliding friction between the stationary base and the rotating ball surfaces is replaced with primarily rolling friction by integrating a plurality of cylindrical or spherical rollers mounted in cradles which are a part of said single molded base piece in the recesses of said single molded piece stationary base and said rollers contacting with point or line contact, and rolling with the spherical ball located in each recess in the base.

4. The apparatus of claim 1, wherein said apparatus has access holes as part of the single molded base piece at the bottom of the recesses traversing through the base to facilitate removal of the spherical balls and to facilitate cleaning and maintenance of the apparatus.

* * * * *